US007984769B2

(12) United States Patent
Haughom et al.

(10) Patent No.: US 7,984,769 B2
(45) Date of Patent: Jul. 26, 2011

(54) METHOD AND A DEVICE FOR DIRECTIONAL CONTROL OF A ROCK DRILLING MACHINE

(75) Inventors: Sigurd Kjell Haughom, Tonstad (NO); Kjeli Knutsen, Tonstad (NO)

(73) Assignee: Norwegian Hard Rock Drilling AS, Tonstad (NO)

( * ) Notice: Subject to any disclaimer, the term of this patent is extended or adjusted under 35 U.S.C. 154(b) by 191 days.

(21) Appl. No.: 12/375,009

(22) PCT Filed: Jul. 12, 2007

(86) PCT No.: PCT/NO2007/000268

§ 371 (c)(1),
(2), (4) Date: Feb. 13, 2009

(87) PCT Pub. No.: WO2008/013458

PCT Pub. Date: Jan. 31, 2008

(65) Prior Publication Data

US 2009/0188717 A1 Jul. 30, 2009

(30) Foreign Application Priority Data

Jul. 24, 2006 (NO) ..... 20063402

(51) Int. Cl.
*E21B 44/00* (2006.01)
*E21B 7/04* (2006.01)
*E21B 4/04* (2006.01)

(52) U.S. Cl. ..... 175/24; 175/61; 175/104

(58) Field of Classification Search ..... 175/61, 175/62, 92, 94, 104, 106, 385, 406, 24
See application file for complete search history.

(56) References Cited

U.S. PATENT DOCUMENTS

| | | | | | |
|---|---|---|---|---|---|
| 1,350,059 | A * | 8/1920 | Blackwell | 175/98 |
| 3,407,887 | A * | 10/1968 | Lee | 175/106 |
| 4,281,723 | A * | 8/1981 | Edmond et al. | 175/76 |
| 4,697,651 | A * | 10/1987 | Dellinger | 175/61 |
| 5,074,366 | A * | 12/1991 | Karlsson et al. | 175/76 |
| 5,139,094 | A | 8/1992 | Prevedel et al. | |
| 7,188,685 | B2 * | 3/2007 | Downton et al. | 175/61 |
| 2003/0034177 | A1 * | 2/2003 | Chitwood et al. | 175/61 |
| 2004/0026128 | A1 | 2/2004 | Krueger et al. | |

OTHER PUBLICATIONS

International Search Report dated Nov. 5, 2007, International Application No. PCT/NO2007/000268.

* cited by examiner

*Primary Examiner* — Kenneth Thompson
(74) *Attorney, Agent, or Firm* — Patterson & Sheridan, L.L.P.

(57) ABSTRACT

A method for the directional control of a rock-drilling machine, the drilling unit (1) of the rock-drilling machine, which is located in a borehole (2), comprising at least a pi-lot drill bit (6) or an underreamer drill bit (8), the drill bit(s) (6, 8) being driven by an electric motor (10) via a gearbox (12), and the drill bit(s) (6, 8) being moved into the rock (3) by means of a feeding rod (4) extending from a feeding machine at the outside the borehole (2), and the drill bit(s) (6, 8), gearbox (12) and motor (10) being pivoted in a controlled manner about a steering axis (18) which is approximately perpendicular to the center axis (26) of the feeding rod (4).

8 Claims, 3 Drawing Sheets

METHOD AND A DEVICE FOR DIRECTIONAL CONTROL OF A ROCK DRILLING MACHINE

This invention relates to a method for controlling a rock-drilling machine. More particularly, it relates to a method for the directional control of a rock-drilling machine, in which the drilling unit of the rock-drilling machine, which is located in a borehole, includes at least a pilot drill bit or an underreamer drill bit, and in which the drill bits are driven by an electric motor via a gearbox near the drill bits. The drill bits are moved into the rock by means of a feeding rod extending from a feeding machine at the outside of the borehole, the drill bits, gearbox and motor being pivoted in a controlled manner about a steering axis which is approximately perpendicular to the longitudinal axis of the feeding rod. The invention also includes a device for practicing the method.

In rock drilling in which the borehole has too small a cross-section for persons to be in the borehole, it is known to use a rock-drilling machine which is provided with one pilot drill bit and at least one underreamer drill bit located behind the pilot drill bit relative to the direction of drilling.

Further, it is known to place a drive motor at the drill bits, the drill bits and motor being fed into the borehole by means of a feeding rod extending from a feeding machine located outside the borehole.

Rock-drilling machines of this kind are controlled directionally by the axis of rotation of the drill bit being given a fixed angle relative to the longitudinal axis of the feeding rod. This causes the drill bits to drill at an angle relative to the feeding rod. The desired direction of drilling is achieved by rotating the feeding rod about the centre axis of the borehole until the drill bits drill in the desired direction.

The method has the effect of the borehole exhibiting a partially considerable helical shape, which makes further movement of the drill bits into the borehole difficult, especially when relatively long boreholes are involved. The helical shape can also make subsequent further underreaming of the borehole difficult.

The invention has for its object to remedy or reduce at least one of the drawbacks of the prior art.

The object is achieved in accordance with the invention through the features, which are specified in the description below and in the claims that follow.

The directional control of a rock-drilling machine in accordance with the invention, in which the drilling unit of the rock-drilling machine is in a borehole, including at least a pilot drill bit or an underreamer drill bit, the drill bits being driven by an electric motor via a gearbox, and the drill bits being moved into the rock by means of a feeding rod extending from a feeding machine at the outside of the borehole, is characterized by the drill bits, gearbox and motor being pivoted in a controlled manner about a steering axis which is approximately perpendicular to the centre axis of the feeding rod.

The position of the drilling unit is monitored by a control system, the rotational angle of the drilling unit about the centre axis of the feeding rod and the steering angle between the drill bits and the feeding rod being adjusted in accordance with the desired value. Otherwise the feeding rod does not rotate beyond the springing rotation caused by the torque of the drill bits.

The steering axis is located between the drill bit and a support at the inner end portion of the feeding rod, the drilling unit being provided with a steering joint including a steering axle. The centre axis of the steering axle coincides with the steering axis.

The steering joint typically includes an axle mount, which is connected to the feeding rod via an intermediate housing, and a bearing housing which is connected to the motor.

An actuator is connected between the axle mount and the bearing housing and is arranged to pivot the bearing housing about the steering axle and relative to the axle mount. The actuator is supplied with pressurized fluid from a circulation pump via a control valve.

The control valve is controlled by the control system on the basis of the measured position of the drilling unit.

The angle $\alpha$ between the centre axis of the drill bit and the centre axis of the feeding rod is monitored by means of a transmitter.

In what follows is described a non-limiting example of a preferred method and embodiment which are visualized in the accompanying drawings, in which.

Figure 1:
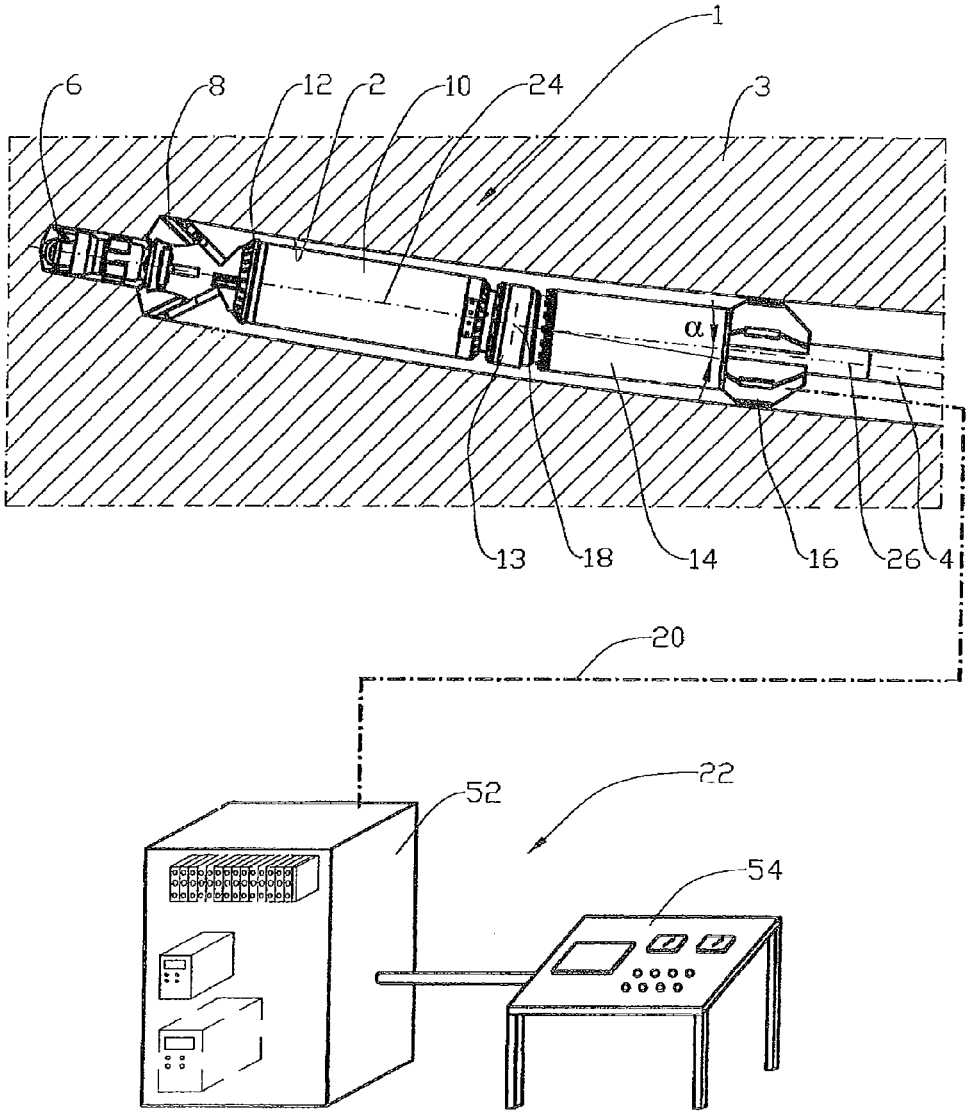
FIG. 1 shows the drilling unit of a rock-drilling machine during drilling in a borehole, the centre axis of the drill bit having been pivoted into an angle relative to the centre axis of the feeding rod, a control device being indicated schematically.

In the drawings the reference numeral 1 indicates a drilling unit of a rock-drilling machine not shown in its entirety. The drilling unit 1 is located in a borehole 2 in the rock 3 and is connected by means of a feeding rod 4 to a feeding machine, not shown, located outside the borehole 2.

The drilling unit 1 includes a pilot drill bit 6 and an underreamer drill bit 8 which is located somewhat behind the pilot drill bit 6. The drill bits 6 and 8 are driven by an electric motor 10 via a gearbox 12.

The motor 10 is connected, together with the gearbox 12 and drill bits 6 and 8, to a steering joint 13 connected in turn to an intermediate housing 14. At its opposite end portion the intermediate housing 14 is fixedly connected to a support 16 and to the inner end portion of the feeding rod 4. The drilling unit 1 bears on the borehole 2 by the drill bits 6, 8 and by the support 16. The pivot axis of the steering joint 13 forms a steering axis 18.

A power and control cable 20 extends along the borehole 2 from a control system 22 located outside the borehole 2 in to the drilling unit 1.

In FIG. 1 the centre axis 24 of the drill bits 6 and 8 has been given an angle $\alpha$ relative to the centre axis 26 of the feeding rod 4.

Figure 2:
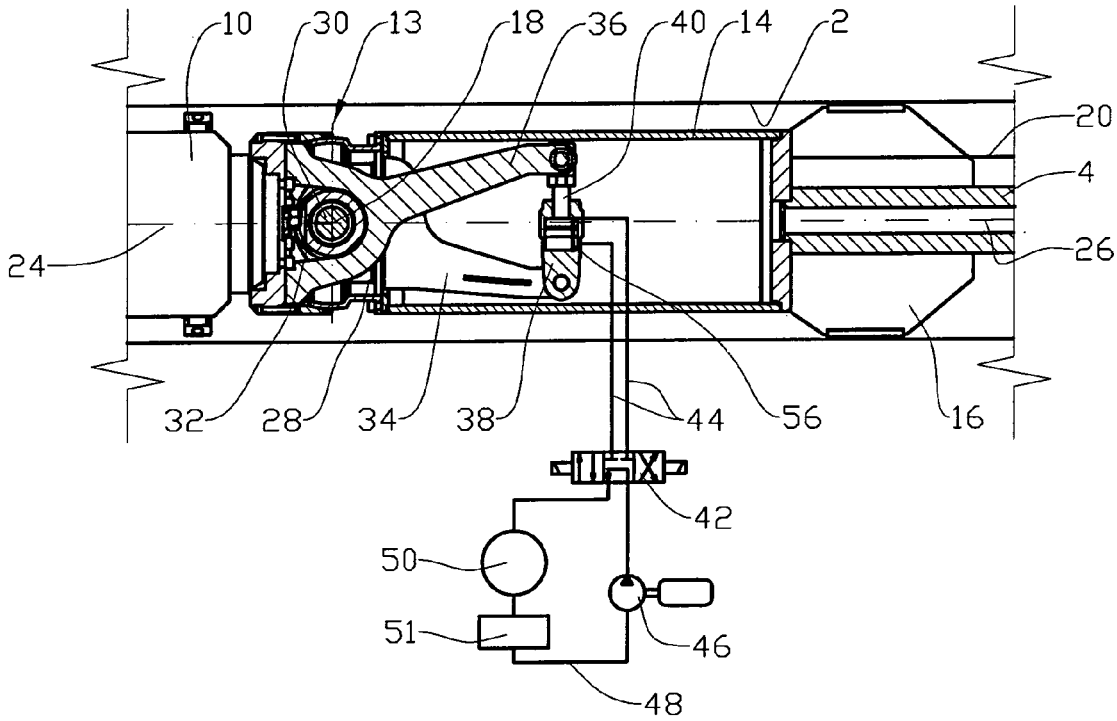
FIG. 2 shows, on a larger scale and partially in section, the steering axle and actuator of the drilling unit, the control valve and hydraulic circuit being shown schematically.

The steering joint 13 is connected to the intermediate housing 14 by means of an axle mount 28, see FIG. 2, supporting a steering axle 30. The centre axis of the steering axle 30 coincides with the steering axis 18.

A bearing housing 32, which is bearingly rotatable about the steering axle 30, is connected to the motor 10. The axle mount 28, steering axle 30 and bearing housing 32 form the steering joint 13. The torque of the motor 10 is transmitted via the steering joint 13, intermediate housing 14 and feeding rod 4 to the feeding machine not shown.

A counter arm 34, which is connected to the axle mount 28, projects somewhat into the intermediate housing 14. Correspondingly, a steering arm 36 connected to the bearing housing 32 also projects somewhat into the intermediate housing 14. An actuator 38, here in the form of a hydraulic cylinder, is connected between the free end portions of the counter arm 34 and the steering arm 36.

Figure 3:
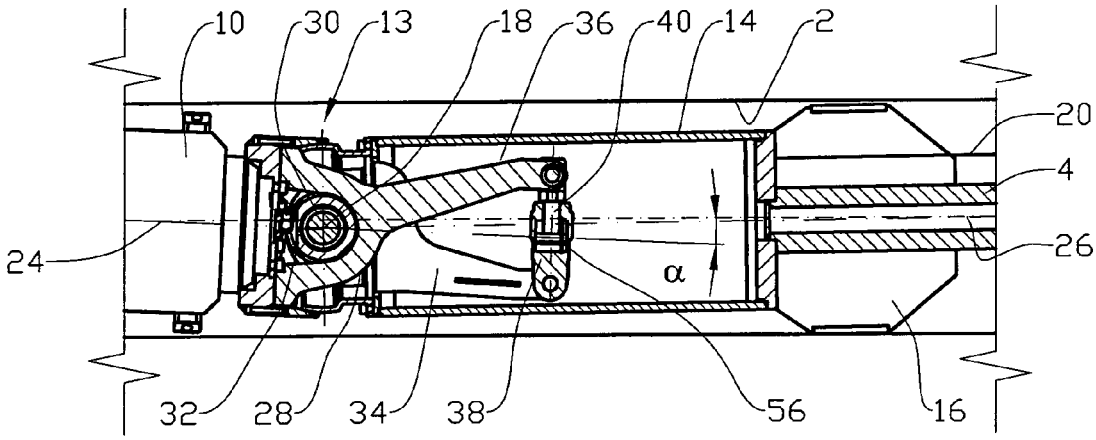
FIG. 3 shows the same as FIG. 2, but here the actuator piston has been displaced.

Movement of the piston rod 40 of the actuator 38 causes the steering arm 36 together with the bearing housing 32, motor 10, gearbox 12 and drill bits 6 and 8 to be pivoted about the steering axis 18, so that the angle α between the centre axis 24 of the drill bits 6, 8 and the centre axis 26 of the feeding rod 4 changes, see FIG. 3.

The actuator 38 is connected to a control valve 42 by means of pipe connections 44. The coupling is shown schematically in FIG. 2. The control valve 42 is supplied with pressurized fluid from a circulation pump 46 via circulation pipes 48. The circulation pump 46 normally circulates fluid to the support of the drill bits 6, 8, indicated here schematically by the reference numeral 50, via a tank 51.

The control valve 42 is controlled and the circulation pump 46 is supplied with energy by means of wires, not shown, via the power and control cable 20.

The control system 22 includes a control cabinet 52 with necessary components and a control console 54. From the control console 54 the position, power consumption and operating temperature, for example, of the rock-drilling machine may be monitored in a manner known per se.

When it is indicated that the direction of drilling of the drilling unit 1 should be adjusted, the feeding rod 4 is rotated, if necessary, about its centre axis 26 until the steering axis 18 takes the desired direction. The control valve 42 is activated so that the piston rod 40 is moved in the actuator 38 until the angle α takes the desired value, which is fed back from a transmitter 56 at the actuator 38.

The circulation pump 46 and control valve 42 is disposed in the intermediate housing 14. The intermediate housing 14 may form a fluid reservoir for pressurized fluid.

Flushing water for cleaning the drill bits 6, 8 is supplied via the feeding rod 4, flowing via conduit elements, not shown, through the intermediate housing 14, steering joint 13, motor 10, gearbox 12 up to the drill bits 6, 8.

The invention claimed is:

1. A method for directional control of a rock-drilling machine, comprising:

locating a drilling unit of the rock-drilling machine in a borehole, the drilling unit comprising at least a pilot drill bit or an underreamer drill bit;

driving the drill bit(s) being by an electric motor via a gearbox;

moving the drill bit(s) into a rock by a feeding rod extending from a feeding machine outside the borehole;

pivoting the drill bit(s), gearbox and motor in a controlled manner about a steering axis which is approximately perpendicular to a centre axis of the feeding rod;

monitoring a position of the drilling unit by a control system; and after monitoring the position, adjusting a rotational angle of the drilling unit about the centre axis of the feeding rod and an angle between a centre axis of the drill bit and the centre axis of the feeding rod in accordance with a desired value.

2. A control device for a rock-drilling machine, a drilling unit of the rock-drilling machine, which is located in a borehole, comprising at least a pilot drill bit or an underreamer drill bit, the drill bit(s) being driven by an electric motor via a gearbox, and the drill bit(s) being moved into a rock by a feeding rod extending from a feeding machine outside of the borehole, characterized in that the drill bit(s), the gearbox and the motor are pivotable about a steering axis which is approximately perpendicular to a centre axis of the feeding rod, and the drilling unit is provided with a steering joint comprising a steering axle, a centre axis of the steering axle coinciding with the steering axis.

3. The device in accordance with claim 2, characterized in that the steering axis is located between the drill bit(s) and a support at an inner end portion of the feeding rod.

4. The device in accordance with claim 2, characterized in that the steering joint is connected to an intermediate housing connected to the feeding rod by an axle mount and to the motor by a bearing housing.

5. The device in accordance with claim 4, characterized in that an actuator is connected between the axle mount and the bearing housing and arranged to pivot the bearing housing relative to the axle mount about the steering axle.

6. The device in accordance with claim 5, characterized in that the actuator is supplied with pressurized fluid from a circulation pump via a control valve.

7. The device in accordance with claim 6, characterized in that the control valve is controlled by a control system on the basis of a measured position of the drilling unit.

8. The device in accordance with claim 7 characterized in that an angle between a centre axis of the drill bit(s) and the centre axis of the feeding rod is monitored by a transmitter.

* * * * *

UNITED STATES PATENT AND TRADEMARK OFFICE

CERTIFICATE OF CORRECTION

PATENT NO. : 7,984,769 B2
APPLICATION NO. : 12/375009
DATED : July 26, 2011
INVENTOR(S) : Haughom et al.

It is certified that error appears in the above-identified patent and that said Letters Patent is hereby corrected as shown below:

In the Inventors:

Please delete "Kjeli" and insert --Kjell-- therefor.

Signed and Sealed this
Fifteenth Day of November, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,984,769 B2
APPLICATION NO. : 12/375009
DATED : July 26, 2011
INVENTOR(S) : Haughom et al.

It is certified that error appears in the above-identified patent and that said Letters Patent is hereby corrected as shown below:

Title Page, Item (75) Inventors, second inventor's first name,

"Kjeli" should read --Kjell--

This certificate supersedes the Certificate of Correction issued November 15, 2011.

Signed and Sealed this
Twentieth Day of December, 2011

David J. Kappos

David J. Kappos
*Director of the United States Patent and Trademark Office*